US009873947B2

(12) United States Patent
Calixto Martinez et al.

(10) Patent No.: US 9,873,947 B2
(45) Date of Patent: Jan. 23, 2018

(54) EASY CLEAN COATING APPLIED ON STAINLESS STEEL METALLIC SURFACES USED IN THE MANUFACTURE OF HOUSEHOLD APPLIANCES

(71) Applicant: MABE, S.A. DE C.V., Queretaro (MX)

(72) Inventors: Maria de los Angeles Calixto Martinez, Queretaro (MX); Ulises Hernandez Orduña, Queretaro (MX); Gilberto Magaña Loredo, Queretaro (MX); Jesus Manuel Salinas Gutierrez, Chihuahua (MX); Virginia Hidolina Collins Martinez, Chihuahua (MX); Juan Francisco Perez Robles, Queretaro (MX); Jesus Gonzalez Hernandez, Chihuahua (MX); Alejandro Lopez Ortiz, Chihuahua (MX)

(73) Assignee: MABE, S.A. DE C.V., Queretaro (MX)

( * ) Notice: Subject to any disclaimer, the term of this patent is extended or adjusted under 35 U.S.C. 154(b) by 288 days.

(21) Appl. No.: 14/133,910

(22) Filed: Dec. 19, 2013

(65) Prior Publication Data

US 2014/0178591 A1 Jun. 26, 2014

(30) Foreign Application Priority Data

Dec. 19, 2012 (MX) ..... MX/a/2012/015209

(51) Int. Cl.

| | |
|---|---|
| ***C23C 18/00*** | (2006.01) |
| ***C23C 26/00*** | (2006.01) |
| ***C23C 18/18*** | (2006.01) |
| ***C23C 18/12*** | (2006.01) |

(52) U.S. Cl.

CPC ..... *C23C 26/00* (2013.01); *C23C 18/1208* (2013.01); *C23C 18/1212* (2013.01); *C23C 18/1216* (2013.01); *C23C 18/1254* (2013.01); *C23C 18/1283* (2013.01); *C23C 18/1837* (2013.01)

(58) Field of Classification Search

CPC ..... C23C 18/04; C23C 18/12; C23C 18/1208; C23C 18/1245

USPC ..... 427/327

See application file for complete search history.

(56) References Cited

U.S. PATENT DOCUMENTS

| | | | | |
|---|---|---|---|---|
| 4,071,380 | A | 1/1978 | Shutt | |
| 4,792,358 | A | 12/1988 | Kimura et al. | |
| 5,147,730 | A | 9/1992 | Ogishi et al. | |
| 5,466,280 | A | 11/1995 | Lee et al. | |
| 5,554,681 | A | 9/1996 | Patel | |
| 6,156,388 | A * | 12/2000 | Endres | C03C 17/007 427/106 |
| 6,162,498 | A * | 12/2000 | Mennig | C03C 1/008 427/226 |
| 7,488,515 | B2 | 2/2009 | Groll | |
| 7,683,293 | B2 | 3/2010 | Buzzi et al. | |
| 8,142,841 | B2 * | 3/2012 | Meagher | C23G 1/08 427/115 |
| 2002/0054998 | A1 * | 5/2002 | Heimann | C23C 28/00 428/446 |
| 2004/0003796 | A1 | 1/2004 | Nomura | |
| 2004/0222105 | A1 * | 11/2004 | Heimann | C23C 26/00 205/674 |
| 2005/0014004 | A1 * | 1/2005 | King | B32B 27/08 428/413 |
| 2005/0208272 | A1 | 9/2005 | Groll | |
| 2007/0054127 | A1 * | 3/2007 | Hergenrother | A61L 27/18 428/411.1 |
| 2008/0118745 | A1 * | 5/2008 | Endres | C09D 1/02 428/336 |
| 2010/0143725 | A1 * | 6/2010 | Araya | C09D 1/04 428/446 |

FOREIGN PATENT DOCUMENTS

| | | |
|---|---|---|
| CN | 1978563 | 6/2007 |
| CN | 101462859 | 6/2009 |
| EP | 2037003 | 3/2009 |
| EP | 2034050 | 11/2009 |
| ES | 2252804 | 5/2006 |
| GB | 1189823 | 4/1970 |
| GB | 1471977 | 4/1977 |
| GB | 2425976 | 11/2006 |
| JP | 63291665 | 11/1988 |
| JP | 11349852 | 12/1999 |
| JP | 2004050772 | 2/2004 |
| KR | 100782640 | 12/2007 |
| RU | 2203233 | 4/2003 |
| WO | WO0146324 | 6/2001 |
| WO | WO2008051789 | 5/2008 |

OTHER PUBLICATIONS

Metal Prep No. 79. https://www.aircraftspruce.com/pages/me/metalprep/metalprep.php, retrieved Feb. 5, 2016. pp. 1-2.*

* cited by examiner

*Primary Examiner* — David Turocy

(74) *Attorney, Agent, or Firm* — Terry M. Sanks, Esq.; Beusse Wolter Sanks & Maire, PLLC

(57) ABSTRACT

The present invention related to a silicon based coating suitable for being applied onto metallic surfaces of a household appliance. The coating of the present invention protects the metallic surfaces of the household appliance against the yellowing or changes in color, through temperatures, among other factors, and eases the cleaning of the same.

11 Claims, 4 Drawing Sheets

EASY CLEAN COATING APPLIED ON STAINLESS STEEL METALLIC SURFACES USED IN THE MANUFACTURE OF HOUSEHOLD APPLIANCES

RELATED APPLICATIONS

This application claims priority from Mexican Application Serial No. MX/a/2012/015209 filed Dec. 19, 2012, which is incorporated herein by reference in its entirety.

FIELD OF THE INVENTION

The present invention is related to a coating which is applied to metallic surfaces such as, for example, brass, aluminum, copper and steel. Preferably the surface is stainless steel, such as, for example those which are used in a household appliance to protect and ease the cleaning of the same.

BACKGROUND OF THE INVENTION

Stainless steels represent a good alternative for the construction of all types of equipment, because they are resistant to homogenous corrosion under controlled conditions in many industrial application types, in household appliances, kitchen utensils, for decorative goals, in architecture etc. However, a problem which faces these types of materials is corrosion, such as when used under inappropriate conditions, for example, high temperatures, marine environments, etc. This is what constitutes the system: "material and its environmental surroundings". When the material and its surroundings react chemically, a change occurs in its nature which, generally, leads to deterioration of its design properties or of its physical characteristics. As a consequence of exposure to inadequate conditions, the materials with which household appliances are manufactured with are subject to crusting (dirtying) with oils and grease originating from the heating of foods. These problems are some of the more common ones in the metal and ceramic cooking utensils, which decrease their value and effective life use.

Temperatures above 200° C. are another factor which affects the appearance of stainless steel, which is reflected with the formation, and increase in the thickness of the chrome oxide layer, which at a simple glance, is seen as a change of color on the surface with a tendency to yellowing. This color change on the surface of a household appliance alerts the user to the fact that his appliance has become dirty, in addition to the grease accumulation encrusted onto the steel surface, and to attempt to get rid of the layer which has formed, a variety of chemical products are used, causing the household appliance appearance to deteriorate, thus causing the user to choose to switch his household appliance and this entails dissatisfaction.

The easy clean coatings applied on glass and other inorganic surfaces have garnered a lot of attention in recent years. Among the main advantages of these materials which have been treated with easy clean films, it has been found that the dirtiness is easily removed given the side effect created by a low energy surface (such as, for example, oleo-phobic, lipo-phobic or hydrophobic) and the more aggressive cleaning agents thus become unnecessary; which makes these coatings highly attractive for applications onto kitchen utensils, household appliances and all appliances exposed to foods, greases and edible oils subjected to continuous use conditions and to temperature cycles (room temperature −350° C.). However, several disadvantages exist with the commercial products which are used to produce coatings over the stainless steel covers, among others are that some of the formulations contain solvents which are health toxic and noxious to the environment, such, as, for example, petroleum and halogenated hydrocarbons, which are not acceptable for the above mentioned applications. There are also those which create coatings with low resistance to abrasion, which translates into materials with short effective life use.

Currently, among the main general characteristics which the easy clean coatings should possess in order to be widely accepted are: water repellence, grease repellence, oil repellence, temperature resistance, abrasion resistance, stability to ultraviolet light and to the cleaning agent products, it should be easily applied in addition to being transparent and non-toxic.

A wide variety of easy clean coatings have been developed, among which we should mention those revealed in the following patent literature:

Publication WO2008/0517879 A1 (Moses, et al, 2008), describes a method for forming an easy to clean coating on a metallic or metalized substrate, by means of a layer formed of silicon, oxygen and hydrogen and at least one part deposited by means of the PD method (plasma-deposited) and one part of a fluoridated compound.

U.S. Pat. No. 4,792,358 (Kimura, at al., 1988) refers to a composition of an inorganic coating which has 100 parts in solid weight with a thermally prepared agglutinant with 10 to 40 weight parts in fine silicon particles in approximately 100 parts in solid weight of potassium silicate and 15 parts in weight of 100 parts of pigment set in mother of pearl in order to create shine.

U.S. Pat. No. 7,683,293 B2 (Buzzi, et al, 2010), presents a protective coating, transparent and high-temperature resistant for use in household appliances, particularly those cooking appliances with metallic surfaces. This coating is deposited on the metallic surfaces by means of Plasma-enhanced chemical vapor deposition (PECVD), which itself incorporates at least one layer of $SiO_2$ and one intermediate layer of SiC. This coating protects the metallic surface is resistant to scratching, soiling and to yellowing due to heating. The method of application of the coating discussed in this invention is by means of Plasma-enhanced chemical vapor deposition of the precursors, which are vaporized to later interact and form chains between them, all of this is undergone in a vacuum deposition chamber and under the action of the plasma.

Chinese patent application No. 1978563 A (Changguo, Huang, 2006), which consists of a re-coating formed by inorganic titanates. The coating precursor is an aqueous suspension containing titanates ($M(II_2TiO_4)$, meta titanates ($M(II)TiO_3$) and titanate mixtures ($M(I)_2Ti_2O_5$); where M refers to the alkaline metals: potassium, lithium and sodium, earth metal alkalines such as, for example, barium, strontium, magnesium and calcium, as well as zinc, iron and aluminum. The re-coating does not contain chrome nor does it present water-absorption problems or softness.

Chinese Patent application No. 101462859 A (Ye, et al., 2009) is related to a re-coating which reduces the stainless steel oxidation in a high temperature oven. The re-coating is composed of silicon oxide, aluminum oxide, magnesium oxide, calcium oxide and boric oxide.

European Patent application number EP 2 034 050 A1 presents as the main objective the providing of a re-coating for steel whose properties are resistance to detachment, resistance to solvents, resistance to the alkali, in addition to an increase in abrasion resistance. This re-coating is a compound material which consists of a resin, polyurethane resin nano-particles and of the copolymerization of carboxylic acid and unsaturated ethylene, a substance with a silanol group and/or alcoxysilane, non-particulate silicon oxide, a titanium organic compound and polyolefin wax particles. In addition to these compounds, the invention recommends adding an agent which can prevent oxidizing, selected among a group of phosphate compounds, thiocarbonyl compounds, niobium oxide and guanidine compounds.

Other documents related to re-coatings are the following: EP 2 037 003 A1, GB 1 471 977 A, JP 63 291 665, RU 2 203 233, U.S. Pat. No. 5,466,280 A, US 2004/03796 A1, ES 2 252 804 13, GB 2 425 976 A, JP 2004/050772, U.S. Pat. No. 4,071,380 A, U.S. Pat. No. 5,554,681 A, US 2005/208272 A1, GB 1 189 823 A, JP 11 349 852, KR 100 782 640, U.S. Pat. No. 5,147,730 A, U.S. Pat. No. 7,488,515 B2, WO 01/46324 A2.

Notwithstanding the wide variety of available re-coatings in the state of the art, there still exists the need to develop new re-coatings which can be used on metallic surfaces, preferably for application onto household appliances with metallic surfaces, which avoid the yellowing of the surface, aid in the cleaning of the same and additionally develop less expensive methods, with easy application, which enable the preparation as well as the application of the coatings.

Advantageously, the coating of the present invention allows the user to accomplish the cleaning of the coated surfaces of the household appliance using solely a sponge or a wet rag, thereby avoiding the use of abrasive products which might damage the metallic surface and thus maintaining the product's appearance for a longer time period.

BRIEF DESCRIPTION OF THE INVENTION

The present invention is directed to a silicon based coating reinforced with one or more compounds comprising tungsten oxide, calcium oxide, and boric oxide which can be applied onto the metallic surfaces through different processes of immersion and/or aspersion.

The coating of the invention avoids the permeability of oxygen towards the steel surface, increases the adhesion, abrasion, grease repellence, oil repellence properties, and additionally is resistant to surrounding temperatures up to 400° C., it is stable to ultraviolet light, resistant to chemical agents, transparent and also maintains its appearance along the length of use.

Given its resistance to high temperatures, the coating of the present invention is useful for its application onto metallic surfaces such as, for example, brass, aluminum, copper and steel and preferably stainless steel, of household appliances: stove covers, refrigerator doors, oven hoods, oven moldings, microwave ovens, stoves, chimneys, for example.

Additionally, the coating of the present invention may be applied onto any type of household appliance with a metallic surface such as, for example, brass, aluminum, copper, steel and preferably stainless steel, such appliances as, for example, washers, dryers, blenders, toasters, knives, mixers, all of which can benefit from the easy to clean coating.

In another aspect, the present invention provides a method for the preparation of the silicon based coating reinforced with other compounds comprising tungsten oxide, calcium oxide, boric oxide of the present invention.

In an additional aspect, the present invention provides a method for the application of the coating through the aspersion and/or immersion techniques, onto metallic surfaces such as, for example, brass, aluminum, copper, steel and preferably stainless steel.

DETAILED DESCRIPTION OF THE INVENTION

The following definitions are provided to allow a better understanding of the invention:

The use of the term "approximately" provides an additional determined range. The term is defined in the following manner. The additional range provided by the term is that of approximately ±10%. By way of example, but not in a imitative manner, if it states "approximately 40 cm", the exact range is between 36 to 44 centimeters.

The color change (ΔE) is measured by means of a color spectrophotometer, which is compared against a standard (stainless steel without a coating).

The coating of the present invention comprises a silicon based compound coating reinforced with one or more compounds comprising tungsten oxide, calcium oxide, and boric oxide. Preferably, the coating of the present invention is obtained from a solution of or a mixture of alkali metal silicates (sodium, potassium and/or lithium), in addition to a silicon oxide, aluminum oxide and titanium oxide nanometric densifier, as well as zirconium oxide, and additionally reinforced with tungstates, molibdates, nickelates and borates.

The coating of the present invention is deposited onto the stainless steel surfaces by means of immersion and/or aspersion techniques, same which have been used for the application of the coating of the invention.

The stainless steels, used according to the present invention are of the ferritic, austenitic, martensitic and Duplex (austenitic-ferritic) type.

The coating of the present invention is applied onto metallic surfaces by means of the immersion and/or aspersion process which can be used widely on surfaces which come into direct contact with high temperatures. As a result, metallic surfaces such as, for example, brass, aluminum, copper, steels and preferably stainless steels, such as, for example, the cover of a stove which comprises knobs, heating pan, steel discs, burners; ovens, microwave ovens, etc. which can be subject to temperatures which oscillate between room temperature up to 400° C. can be coated with the coating of the present invention.

Figure 1:
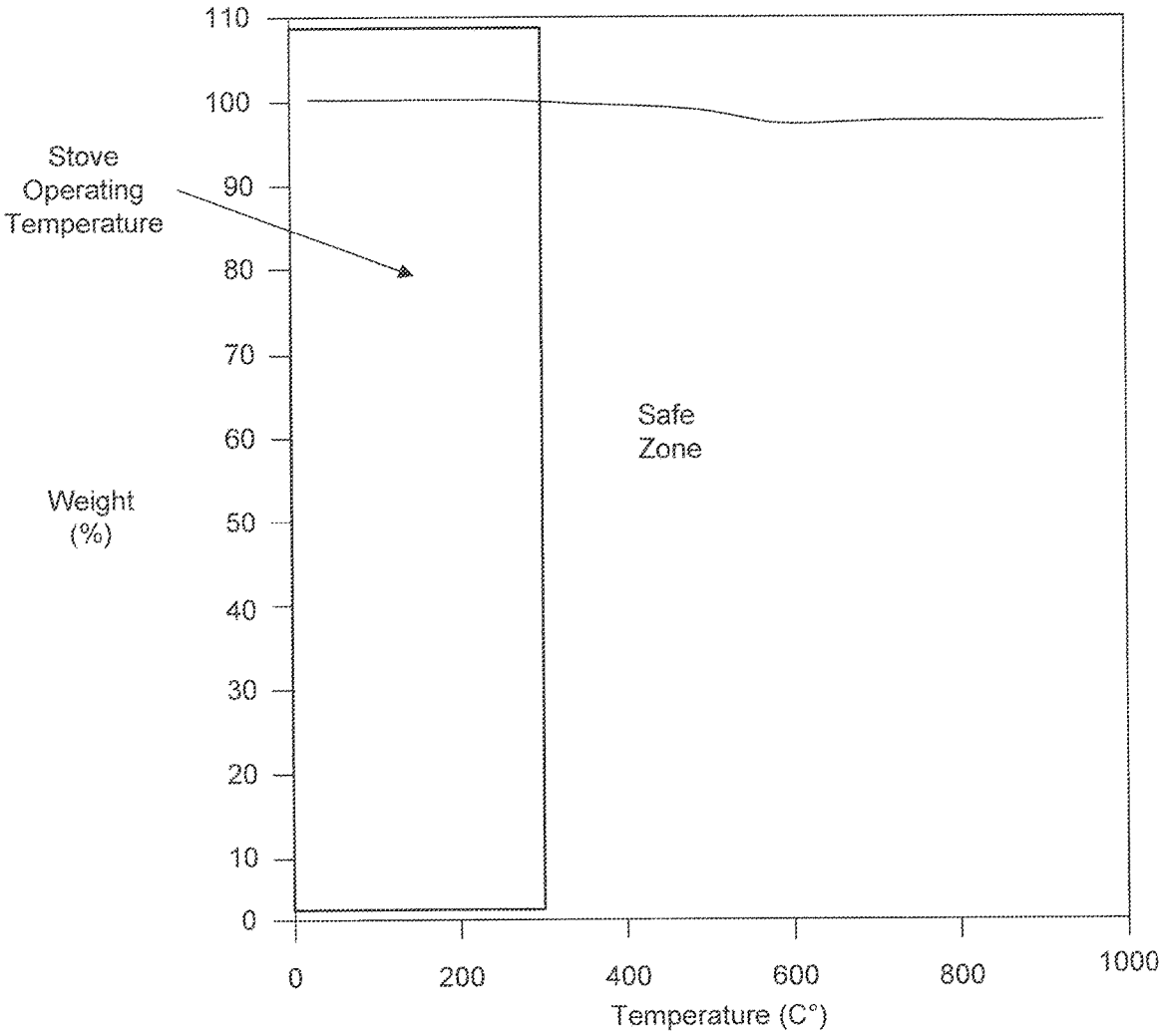
FIG. 1—Presents the thermal gravimetric analysis (TGA) and its first derivation, wherein the behavior of the coating with respect to temperature of the present invention can be appreciated. In this Figure, one can clearly see the thermal stability of the coating withstanding temperatures higher than those operational in an oven (room temperatures ~400° C.).

The high resistance to the temperature of the coating which is shown in the thermal gravimetric analysis (FIG. 1) allows for having a safety area under 500° C. (approximately 297.8° C.), in which, the coating is stable and does not present weight loss. FIG. 1 shows said safety area, wherein additionally, the operational temperature of the stove is shown as being much lower than said safety area. This stability allows it to be used on any part of the stove, given that the operational temperature is found to be lower than that of this safety area.

Other properties of the nano-structured coating of the present invention, which has a thickness approximately between 0.5 to 2.0 microns, is its resistance to thermal shock, to vapor exposure, it has a hardening of 9H, it inhibits oxygen permeation, it does not change the appearance of the metallic surface (transparent), in addition to conferring it with preservation properties (its appearance is preserved through time and use avoiding the change in color through oxidation on the surface).

The safety zone and the properties of the coating prevent the metallic surface of the household appliance from staining, or from changing color or appearance, etc. Additionally, the cleaning of the parts which contain the coating eases the actual cleaning and creates a grease repellant. On this point, without wishing to limit ourselves by the theory, the coating of the invention is one of a lipo-oleophobic and hydrophobic type, which is grease repellant, oil repellant and aqueous solution repellant, and which does not allow foods to become anchored onto the surface, thereby avoiding a high degree of soiling, grease adherence and easing in the cleaning of the surface.

Figure 2:
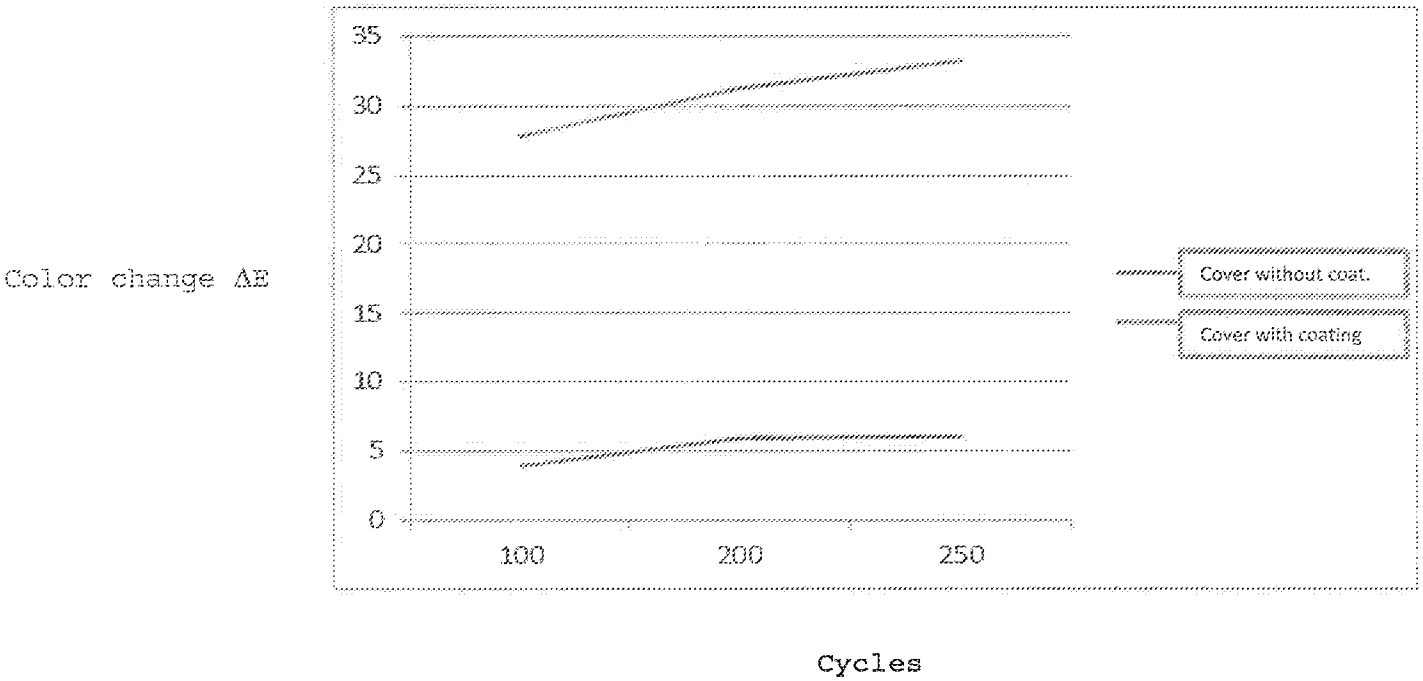
FIG. 2—Is a graph which shows resistance to changes in color of the coating of the present invention with respect to the operation cycles of a cover of a stove.
Figure 3:
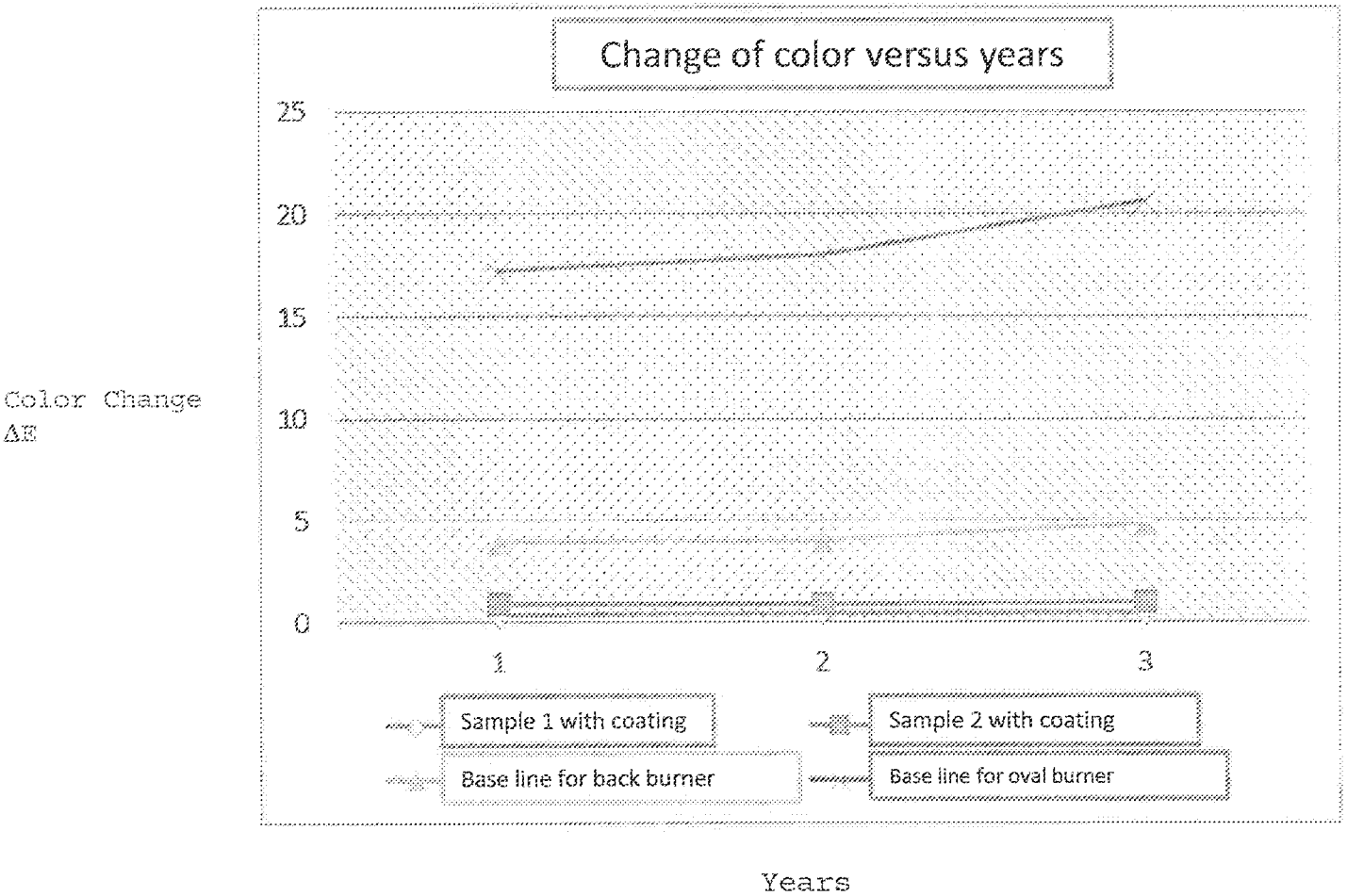
FIG. 3—Is a graph which illustrates resistance to the changes in color of the coating of the present invention applied to the cover of a conventional oven plotted against the passage of years.

FIGS. 2 and 3 illustrate the resistance to color changes (yellowing), given the repeated exposure to temperature cycles (room to 315° C.). The analysis of these figures shows that the coating of the present invention grants protection to the surface of the covers of household appliance stoves.

Preparation and Coating of Metallic Surfaces Method

The coating of the present invention is prepared using the sol-gel method, which has been adapted for the present invention.

Potential advantages which this method presents versus the traditional techniques are summarized as follows:

High degree of homogeneity and purity of the materials

High thermal stability

Ease of addition of elements within the network of materials.

An excellent degree of hydroxylation of the material. With stable OH groups up to temperatures nearing 400° C.

Allows the design of structural, texture, optic properties, varying the synthesis parameters.

To generate oleo-phobic type effects, the coatings must provide the substrates a low-energy surface.

The process for the preparation and application of the coating of the present invention comprises the following steps:

a) Cleaning of the pieces—they are washed with water and a degreasing agent, for example a detergent.

b) Rinsing—rinse with water at a 40° C. temperature approximately and with a physical action by means of agitation which aids in the cleaning of the surface.

c) Activation—the surface is activated using acids, such as, for example, sulfuric acid in concentrations from to 1% up to 15% by weight or nitric acid in concentrations from to 5% up to 10% by weight. The time of exposure to the acid is in a range of approximately 0 to 20 minutes.

d) Rinsing—the surface is rinsed with water.

e) Hydroxylation—the surface is hydroxylized using basic solutions, preferably sodium hydroxide, with a concentration range between 1% to 20% by weight, and a permanence time is used between approximately 0 to 20 minutes.

f) Coating—the depositing of the silicon based compound coating reinforced with other oxides comprising, tungsten oxide, calcium oxide, and boric oxide is applied by means of immersion controlling the entrance and exiting velocities of the piece, the residence time of the coating solution is approximately 0 to 2 minutes.

g) Curing treatment—the coating is cured in three steps or heating areas. The first heating area has a range of approximately 0° to 120° C., with a temperature ascending to a velocity with a range of approximately 1° C. to 5° C. per minute, the second step reaches approximately 320° C. with a temperature ascending to a velocity with a range of approximately 1° C. to 10° C. per minute, the last step reaches approximately 420° C. with a temperature ascending to a velocity with a range of approximately 1° C. to 15° C. per minute. Upon finalizing each temperature increment, isothermal periods are undergone (0 to 60 minutes).

h) Cooling—the piece is cooled at room temperature and remains ready to be assembled into the household appliance.

The coating was subjected to the following tests to prove its adhesion, abrasion, water repellence, grease repellence, resistance to temperatures above 400° C., stability in ultraviolet light, to chemical agents and that it maintains its appearance.

The performance of the coated pieces was evaluated subject to the following tests:

Standard test method for measuring adhesion according to the ASTM D-3359B specification—This method indicates the procedure of the adherence between the film and the substrate by applying an adhesive film over the cut area on the film. The coating of this invention meets with the 5B adherence.

Film hardness by pencil test according to ASTM D-3363—This method is used to evaluate the organic coatings over a substrate, the pencils are calibrated from graphite hardness ranging from 6B up to 9H. The coating of this invention meets with a 9H hardness.

Abrasion test according to norm ASTM D4060—This determines the ability which the coating has to mechanical degradation. The results are expressed in terms of weight loss in the coating which can be from 500 to 1000 revolutions. The coating has a weight loss of 0.0007 grams using one kilogram in weight load, during 1000 cycles and using a CS-17 type of rock to be used.

Staining test according to norm ASTM D1308—Various food products are placed on the coating for a pre-determined amount of time and temperature. The coating of this invention meets with the appearance standards (change of color, loss of shine, adhesion without bubbling etc.)

Humidity test ASTM D 1735—The coating meets with 720 hours in the humidity chamber without presenting a change in coloring, bubbling or detachment. The coating of this invention meets with the specification.

Standard Method for Thermal shock test ASTM C385—the coating of this invention meets with the specification.

The coating of this invention meets with the properties which grant the metallic surfaces of household appliances protection, preferably those manufactured with stainless steel, as well as protection against staining, yellowing and aids in the cleaning of the same.

Example 1—Measurement of the Color Change of the Coating of the Present Invention Throughout the Years A stainless steel first plate coated with the coating of the present invention was placed on the cover of a conventional stove, measuring 10×10 cm (example 1) near the backburner of the cover and a second 10×10 cm stainless steel plate also coated with the coating of the present invention was placed near the oval burner.

The color change was measured at year one, at year two and at year three after the following use conditions: at one hour of exposure to 400° C. and at one hour of exposure to room temperature.

The results are shown in FIG. 3.

It was observed that the coating did not change color at the end of the three year term as opposed to the cover without the coating, which starting on the first year changed color with a yellowing tendency. It was concluded that the coating of the present invention prevents yellowing and maintains its appearance through time.

Example 2—Measurement of Color Change of the Coating of the Present Invention Through Multi-Cycles The change in color of a cover with the coating and another cover without the coating was determined at multi-cycle cycles. The cover with coating and the cover without coating in a conventional stove and, particularly, the triple ring burner of each one of said covers, were subjected to heating for 250 cycles, wherein each cycle represents one hour turned on at a maximum capacity (approximately 270° C.) and one half hour turned off.

Upon finalizing the 25 cycles the cover without the coating was found to present a color change of 33.22 (according to ASTM 02244-11), whereas the cover with the coating of the present invention only presented a color change of 5.99 (according to ASTM 02244-11). The results of said experiment are shown in FIG. 2.

It is concluded that the coating of the present invention is effective against color changes and yellowing of the pieces subjected to temperatures in a household appliance.

Example 3—Ease of Cleaning of the Coating of the Present Invention

A conventional stove cover was coated with the coating of the present invention. Over said cover the following foods, which are frequently used by a user, were poured: tomato, lime, milk, oil, lard and lard/oil. It complies with the method ASTM D.

The cover stained with the before mentioned foods was subjected to heating conditions, that is, the four burners and the oven were kept on for one hour, followed by three hours of being cooled down.

The same experiment under the same heating conditions was carried out at year one, year two and year three of continuous use of the cover with the coating.

Figure 4:
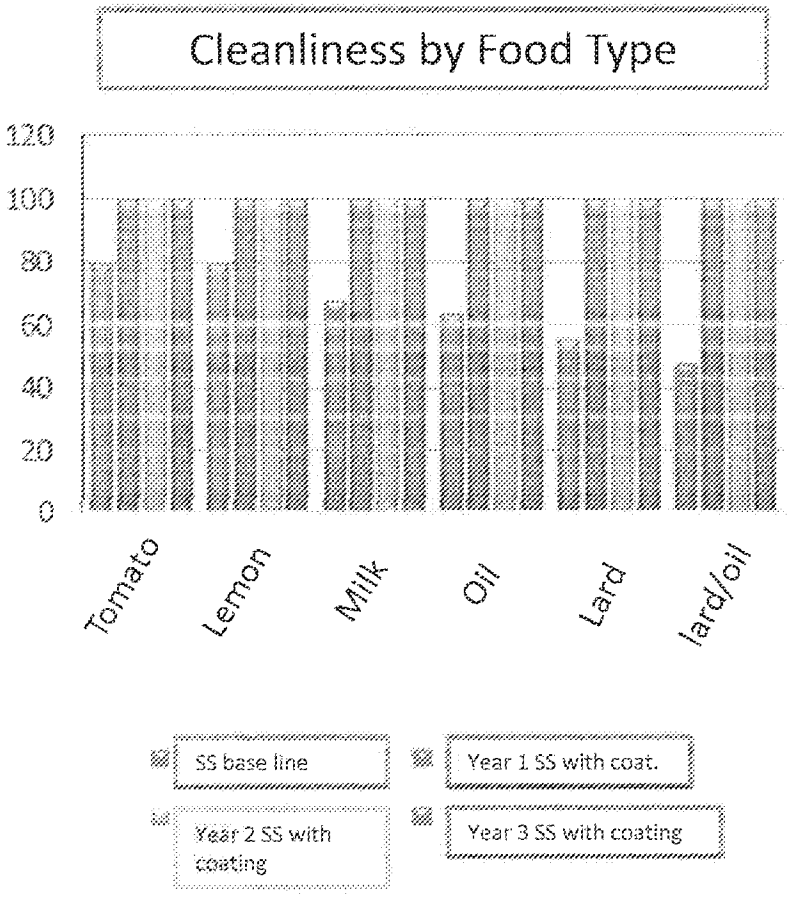
FIG. 4—Is a graph showing the easiness of cleaning of the coating of the present invention through a period of use of time of three years.

The experiment allowed arriving at the conclusion that despite the passage of time and the conditions of use, the cover protected by the coating of the present invention is easily cleanable. The results are shown in FIG. 4.

As will be apparent to a person skilled in the field of the invention, the present invention covers any variation or modification which does not depart from the scope of the present invention described.

The invention claimed is:

1. A method for the application of a coating comprising a silicon base compound reinforced with one or more compounds comprising tungsten oxide, calcium oxide, and boron oxide to metallic surfaces of a household appliance to provide protection against staining and yellowing and to facilitate cleaning of said surfaces, the method consisting of:

a) cleaning the metallic surfaces to be coated by washing the surfaces with water and a detergent to degrease the metallic surfaces;

b) rinsing the metallic surfaces with water;

c) activating the metallic surfaces using an acid;

d) rinsing the metallic surfaces with water;

e) hydroxylating the metallic surfaces using a sodium hydroxide solution having a concentration from approximately 1% to approximately 20% by weight to generate OH groups on the metallic surface;

f) after step e) applying the silicon-based coating directly to the metallic surfaces comprising hydroxyl ("OH") groups;

g) after step f) curing the coated surfaces in three continuous heating stages, the first heating step has a range from approximately 0° C. to approximately 120° C., with a temperature ascending to a velocity in a range from approximately 1° C. per minute to approximately 5° C. per minute, followed by an isothermal period ranging from 0 to 60 minutes; starting the second heating step reaching 320° C. with a temperature ascending to a velocity in a range from approximately 1° C. per minute to approximately 10° C. per minute followed by an isothermal period ranging from 0 to 60 minutes and starting the last heating step up to reaching 420° C. with a temperature ascending to a velocity in a range from approximately 1° C. per minute to 15° C. per minute followed by an isothermal period ranging from 0 to 60 minutes; and h) cooling the cured surfaces.

2. The method according to claim 1, wherein the acid used in the activating step is selected from one of a solution of sulfuric acid with a concentration ranging from approximately 1% by weight to approximately 15% by weight, and a solution of nitric acid with a concentration ranging from approximately 5% by weight to approximately 10% by weight.

3. The method according to claim 1, wherein the applying of the coating to the surfaces during step f) is performed by way of one of aspersion, immersion and a combination of both.

4. The method of claim 1, wherein the coating on the metallic surface has a thickness of approximately between 0.5 to 2.0 microns, a hardening of 9H, impermeable to oxygen, stable and maintain weight at temperatures under 500° C.

5. The method of claim 1, wherein the coating on the metallic surface is lipo-oleophobic and hydrophobic type.

6. The method of claim 1, wherein the time of exposure to the acid during step c) ranges from approximately 0 to 20 minutes.

7. The method of claim 1, wherein metallic surfaces have a permanence time during step e) between approximately 0 to 20 minutes.

8. The method of claim 1, wherein metallic surfaces have a residence time during step f) between approximately 0 to 2 minutes.

9. The method of claim 1, wherein the coated surface during step h) is cooled at room temperature.

10. The method of claim 1, wherein the metallic surfaces are selected from brass, aluminum, copper, steel and stainless steel.

11. The method of claim 1, wherein the rinsing step b) is performed at approximately 40° C. and with agitation to aid in the cleaning of the metallic surfaces.

* * * * *